US008604716B2

(12) United States Patent
Ito et al.

(10) Patent No.: US 8,604,716 B2
(45) Date of Patent: Dec. 10, 2013

(54) LED DRIVE CIRCUIT

(75) Inventors: Hiromasa Ito, Yasu (JP); Yoshinori Kitamura, Konan (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 100 days.

(21) Appl. No.: 12/625,647

(22) Filed: Nov. 25, 2009

(65) Prior Publication Data

US 2010/0066271 A1 Mar. 18, 2010

Related U.S. Application Data

(63) Continuation of application No. PCT/JP2008/059716, filed on May 27, 2008.

(30) Foreign Application Priority Data

May 31, 2007 (JP) ..... 2007-144761

(51) Int. Cl.
*G05F 1/00* (2006.01)

(52) U.S. Cl.
USPC ..... 315/309; 315/291; 315/185 S; 315/307; 315/312

(58) Field of Classification Search
USPC ..... 315/291, 307
See application file for complete search history.

(56) References Cited

U.S. PATENT DOCUMENTS

| | | | | |
|---|---|---|---|---|
| 5,907,569 | A * | 5/1999 | Glance et al. | 372/29.021 |
| 5,939,839 | A | 8/1999 | Robel et al. | |
| 6,127,784 | A * | 10/2000 | Grossman et al. | 315/159 |
| 6,693,394 | B1 * | 2/2004 | Guo et al. | 315/291 |
| 7,626,346 | B2 * | 12/2009 | Scilla | 315/309 |
| 7,948,190 | B2 * | 5/2011 | Grajcar | 315/291 |
| 2001/0043113 | A1 | 11/2001 | Hoshino et al. | |

FOREIGN PATENT DOCUMENTS

| | | | |
|---|---|---|---|
| JP | 63-018862 | U | 2/1988 |
| JP | 64-010684 | A | 1/1989 |
| JP | 01-124011 | A | 5/1989 |
| JP | 2000-299663 | A | 10/2000 |
| JP | 2002-009343 | A | 1/2002 |
| JP | 2002-064223 | A | 2/2002 |
| JP | 2002009343 | * | 11/2002 |
| JP | 2002-359090 | A | 12/2002 |
| TW | I242299 | B | 10/2005 |

OTHER PUBLICATIONS

Components. PTC thermistors as current limiters for LEDs. No chance of heat death. Sep. 2006. http://www.epcos.com/web/generator/Web/Sections/Components/Page,locale=en,r=263282,a=305984.html.*

(Continued)

*Primary Examiner* — Tuyet Thi Vo
(74) *Attorney, Agent, or Firm* — Keating & Bennett, LLP

(57) ABSTRACT

An LED drive circuit that sufficiently exhibits the performance of an LED element to obtain a favorable luminance at room temperature, includes a constant-current circuit including an LED element, a constant-current output unit, and a temperature sensing element having a negative resistance-temperature coefficient. The LED element is connected to the constant-current output unit in series. The constant-current output unit is connected to the LED element in parallel. Due to changes in the resistance value of the constant-current output unit caused by changes in temperature, the value of a current passing through the LED element is increased at room temperature and the value of a current passing through the temperature sensing element is reduced at high temperature.

4 Claims, 3 Drawing Sheets

(56) References Cited

OTHER PUBLICATIONS

ZE 0500, Feature Article, Zetex Semiconductors, Oct. 5, 2006, 8 Pages.*
Official Communication issued in International Patent Application No. PCT/JP2008/059716, mailed on Jun. 24, 2008.
Official Communication issued in corresponding European Patent Application No. 08764744.2, mailed on Feb. 10, 2012.
Official Communication issued in corresponding Japanese Patent Application No. 2009-516325, mailed on Jul. 3, 2012.

* cited by examiner

LED DRIVE CIRCUIT

BACKGROUND OF THE INVENTION

1. Field of the Invention

The present invention relates to an LED drive circuit and, in particular, to an LED drive circuit for driving an LED element, for example, used as the backlight of the liquid crystal screen of a cell phone, a portable game machine, or the like.

2. Description of the Related Art

An LED element is used as a lighting element, for example, in the backlight of a traffic signal or a liquid crystal display. Also, in recent years, an LED element has been used in the backlight of the liquid crystal screen of a small-size, portable apparatus, such as a cell phone or a portable game machine. As a drive circuit for an LED element in a small-size, portable apparatus as described above, there has been disclosed an LED drive circuit that includes a booster circuit for boosting the voltage by switching the output of a battery and a constant-current circuit for driving an LED element at a constant current and drives the LED element substantially at a constant current and a constant voltage (see, for example, Japanese Unexamined Patent Application Publication No. 2002-359090).

It is known that an LED element suffers thermal damage, such as brownout, due to an increase in the temperature of internal substances included in the LED element at high temperature (for example, 30° C. or more). To avoid this, it is known that the amount of a current to be passed through must be made smaller than that at room temperatures (for example, 10° C. to 30° C.). For this reason, LED element manufacturers indicate the allowable forward current for usage. For example, FIG. 5 shows one example of the allowable forward current of an LED element. According to this example, the allowable forward current is set so that it abruptly decreases as the temperature increases, as shown by a characteristic A of FIG. 5. For this reason, in a related-art LED drive circuit, a circuit is designed so that a current having a constant value that does not exceed the allowable forward current at high temperature passes through the LED element, as shown by a characteristic B of FIG. 5.

However, driving the LED element at a current having such a value means driving the LED element at a current having a value much smaller than the allowable forward current at room temperatures. Therefore, a sufficient luminance cannot be obtained. For this reason, in order to obtain a necessary luminance, multiple LED elements may need to be used. However, in the small-size, portable apparatus field where further downsizing and layer-thickness reduction are in progress, it is required to obtain a sufficient luminance with the least possible LED elements and parts thereof.

SUMMARY OF THE INVENTION

Accordingly, preferred embodiments of the present invention provide an LED drive circuit that can sufficiently exhibit the performance of an LED element to obtain a favorable luminance at room temperatures.

According to a preferred embodiment of the present invention, an LED drive circuit includes an LED element, a constant-current output unit arranged to output a constant current, and a temperature sensing element having a negative resistance-temperature characteristic. The LED element, the constant-current output unit, and the temperature sensing element constitute a constant-current circuit. The LED element is connected to the constant-current output unit in series. The temperature sensing element is connected to the LED element in parallel. By constructing the constant-current circuit to include the LED element, constant-current output unit, and temperature sensing element and connecting the LED element and temperature sensing element in parallel, a constant current outputted from the constant-current output unit is divided and sent to the LED element and temperature sensing element. Since the temperature sensing element has a negative resistance-temperature characteristic, the resistance value thereof decreases as the temperature increases. For this reason, as the temperature increases, the value of a current passing through the temperature sensing element increases and the value of a current passing through the LED element decreases. This makes it possible to pass a current having a large value through the LED element at room temperature and to reduce the value of a current passing through the LED element as the temperature becomes higher than room temperature. This makes it possible to drive the LED element at a current value close to the temperature characteristic of the allowable forward current of the LED element.

Such an LED drive circuit may further include a fixed resistance connected to the temperature sensing element in series. A series connecting portion including the temperature sensing element and the fixed resistance may be connected to the LED element in parallel.

By connecting the fixed resistance to the temperature sensing element in series, it is possible to adjust the temperature change rate of the combined resistance value of the series connecting portion including these elements and to adjust the amount of a current passing through the LED element. This makes it possible to drive the LED element at a current having a value close to a change in the allowable forward current of the LED element due to a change in the temperature. Also, by connecting the series connection portion including the temperature sensing element and fixed resistance to the LED element in parallel, flow of a current having a certain level or more into the temperature sensing element can be prevented. That is, since the resistance value of the temperature sensing element decreases at high temperature, a larger amount of current than that at room temperature passes through the temperature sensing element. This may result in self-heating of the temperature sensing element, causing thermal runaway. However, by connecting the fixed resistance having a predetermined resistance to the temperature sensing element in series, the amount of a current flowing into the temperature sensing element can be prevented.

In the LED drive circuit where the temperature sensing element is connected to the LED element in series, if a resistance value of the LED element at a temperature T is represented by $R_L$, a resistance value of the temperature sensing element at the temperature T is represented by $R_S$ at the temperature T, an allowable forward current of the LED element is represented by $I_M$, and a value of a current outputted from the constant-current output unit at the temperature T is represented by I, a relationship $I_M > I/\{(R_L/R_S)+1\}$ is preferably established.

Also, in the LED drive circuit where the series connecting portion including the temperature sensing element and fixed resistance is connected to the LED element in parallel, if a resistance value of the LED element at a temperature T is represented by $R_L$, a combined resistance of a series circuit including the temperature sensing element and the fixed resistance at the temperature T is represented by $R_T$, an allowable forward current of the LED element at the temperature T is represented by $I_M$, and a value of a current outputted from the constant-current output unit at the temperature T is represented by I, a relationship $I_M > I/\{(R_L/R_T)+1\}$ is preferably established.

If the temperature sensing element is connected to the LED element in parallel, the value of a current passing through the LED element is given by $I/\{(R_L/R_S)+1\}$. If the series connecting portion including the temperature sensing element and fixed resistance is arranged such that the series connecting portion is in parallel with the LED element, the value of a current passing through the LED element is given by $I/\{R_L/R_T)+1\}$. Therefore, by selecting the temperature sensing element and fixed resistance so that the above-mentioned relationship is established, it is possible to pass a current having a value lower than the allowable forward current through the LED element. This makes it possible to obtain a sufficient luminance at room temperature without damaging the LED element.

According to various preferred embodiments of the present invention, a simple configuration like the series connecting portion including the temperature sensing element and fixed element is used. This makes it possible to bring the value of a current passing through the LED element close to the allowable forward current within the range of the allowable forward current of the LED element. This makes it possible to sufficiently exhibit the functions of the LED element at room temperature to obtain a favorable luminance.

The above-mentioned and other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
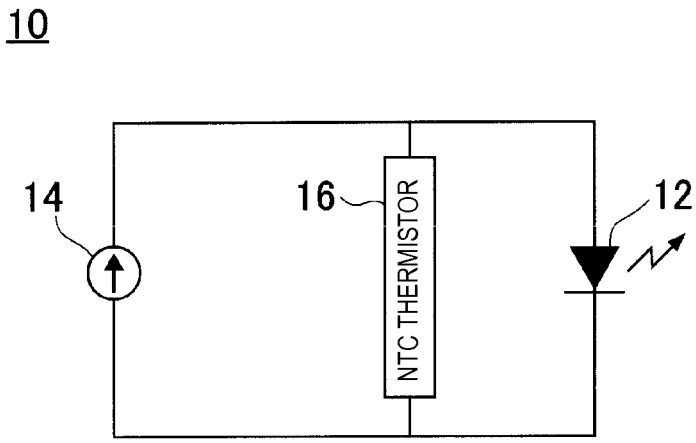
FIG. 1 is a circuit diagram showing an example of an LED drive circuit according to a preferred embodiment of the present invention.

FIG. 1 is a circuit diagram showing one example of an LED drive circuit according to a preferred embodiment of the present invention. An LED drive circuit 10 includes an LED element 12. The LED element 12 is connected to a constant-current output unit 14 in series.

The constant-current output unit 14 may be a constant-current source arranged to output a constant current, or a constant-current circuit connected to a constant-voltage source so as to output a constant current, as long as it outputs a constant current. A temperature sensing element 16 having a negative resistance-temperature characteristic is connected to the LED element 12 in parallel. As the temperature sensing element 16 as described above, for example, an NTC thermistor or other suitable element is preferably used. The LED element 12, constant-current output unit 14, and temperature sensing element constitute a constant-current circuit, which serves as the LED drive circuit 10.

Figure 5:
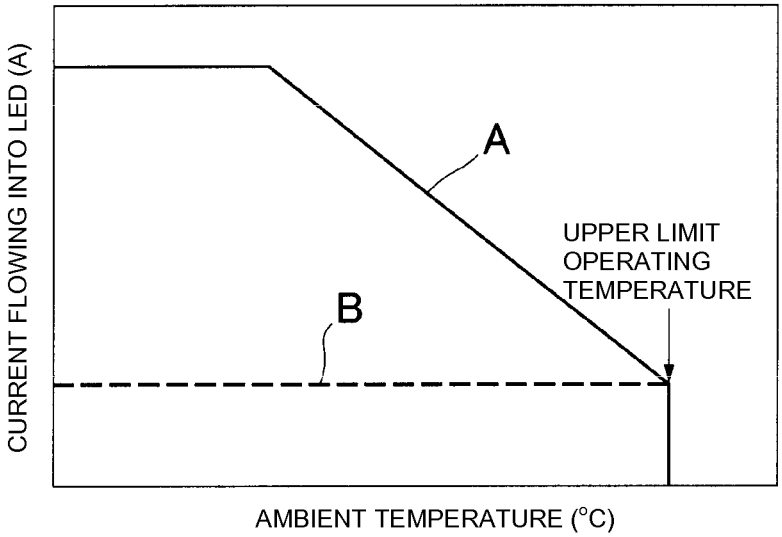
FIG. 5 PRIOR ART
FIG. 5 is a graph showing the allowable forward current of an LED element and the value of a current flowing into an LED element in a related-art LED drive circuit.

In the LED drive circuit 10, a current outputted from the constant-current output unit 14 is divided into a current to be passed through the LED element 12 and a current to be passed through the temperature sensing element 16. The temperature sensing element 16 has a characteristic where the resistance value is high at room temperatures and decreases as the temperature increases. Therefore, at room temperature, the value of a current passing through the LED element 12 is large and the value of a current passing through the temperature sensing element 16 is small. However, as the temperature increases, the value of a current passing through the temperature sensing element 16 increases and only a current having a small value passes through the LED element 12. Therefore, a current having a value indicating a temperature characteristic according to the characteristic A of FIG. 5 passes through the LED element 12.

If the resistance value of the LED element 12 at a temperature T is represented by $R_L$, the value of a current passing through the LED element 12 at the temperature T is represented by $I_L$, the resistance value of the temperature sensing element 16 at the temperature T is represented by $R_S$ at the temperature T, the value of a current passing through the temperature sensing element 16 at the temperature T is represented by $I_S$, and the value of a current outputted from the constant-current output unit 14 at the temperature T is represented by I, $I=I_L+I_S$ and $I_S \cdot R_S=I_L \cdot R_L$.

From these expressions, the value $I_L$ of a current passing through the LED element 12 at the temperature T is given by $I_L=I/\{(R_L/R_S)+1\}$. Therefore, if the allowable forward current of the LED element 12 at the temperature T is represented by $I_M$, a current having a value that is lower than the allowable forward current and in accordance with the characteristic A of FIG. 5 can be passed through the LED element 12 by selecting the temperature sensing element 16 so that $I_M>I_L$, that is, $I_M>I/\{(R_L/R_S)+1\}$.

As seen, in the LED drive circuit 10, a current having a value according to the temperature characteristic of the allowable forward current of the LED element 12 can be passed through the LED element 12. Thus, the value of a current passing through the LED element 12 at room temperatures can be made larger than that in the related-art LED drive circuit. Thus, a favorable luminance can be obtained. Also, even when the temperature increases, only a current lower than the allowable forward current is allowed to pass through the LED element 12. This can prevent breakage of the LED element 12.

By adopting the LED drive circuit 10, a current according to the allowable forward current of the LED element 12 can be passed through the LED element 12. However, depending on the characteristics of the LED element 12 or temperature sensing element 16, only a current lower than the allowable forward current may be passed through the LED element 12. Also, depending on the characteristics of the LED element 12 or temperature sensing element 16, a current flowing into the temperature sensing element 16 may increase. In this case, self-heating of the temperature sensing element 16 may increase, causing thermal runaway.

Figure 2:
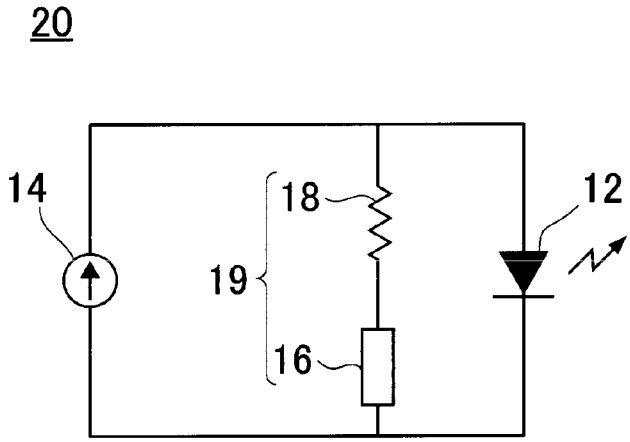
FIG. 2 is a circuit diagram showing another example of the LED drive circuit according to a preferred embodiment of the present invention.

For this reason, an LED drive circuit 20 where a fixed resistance 18 is connected to the temperature sensing element 16 in series and a series connecting portion 19 including the temperature sensing element 16 and fixed resistance 18 is connected to the LED element 12 in parallel, as shown in FIG. 2, is considered. By changing the combination of the temperature sensing element 16 and fixed resistance 18 in accordance with the LED element 12, design flexibility can be made greater than that of the LED drive circuit 10. This makes it possible to design a circuit having a temperature characteristic similar to changes in the allowable forward current.

Also, by connecting the fixed resistance 18 to the temperature sensing element 16 in series, flow of a current having a certain level or more into the temperature sensing element 16 can be prevented. This can prevent thermal runaway due to self-heating of the temperature sensing element 16.

For the LED drive circuit 20, if the resistance value of the LED element 12 at the temperature T is represented by $R_L$, the combined resistance value of the series connecting portion 19 including the temperature sensing element 16 and fixed resistance 18 at the temperature T is represented by $R_T$, and the value of a current outputted from the constant-current output unit 14 at the temperature T is represented by I, the value $I_L$ of a current passing through the LED element 12 at the temperature T in the LED drive circuit 20 is given by $I_L=I/\{(R_L/R_T)+1\}$. Therefore, if the allowable forward current of the LED element 12 at the temperature T is represented by $I_M$, a current having a value that is lower than the allowable forward current and in accordance with the characteristic A of FIG. 5 can be passed through the LED element 12 by selecting the temperature sensing element 16 and fixed resistance 18 so that $I_M>I_L$, that is, $I_M>I/\{(R_L/R_T)+1\}$.

Also, even when connecting the temperature sensing element 16 having a negative resistance-temperature characteristic to the LED element 12 in parallel in the circuit where the LED element 12 is connected to the constant-voltage source in series, a voltage applied to the LED element 12 is constant. Therefore, any function that prevents a current from passing through the LED element 12 does not occur. Therefore, by connecting the temperature sensing element 16 to the LED element 12, which is connected to the constant-current output unit 14, in parallel, the advantages of the present invention can be obtained.

First Preferred Embodiment

Hereafter, working examples of a preferred embodiment of the present invention will be described.

Figure 3:
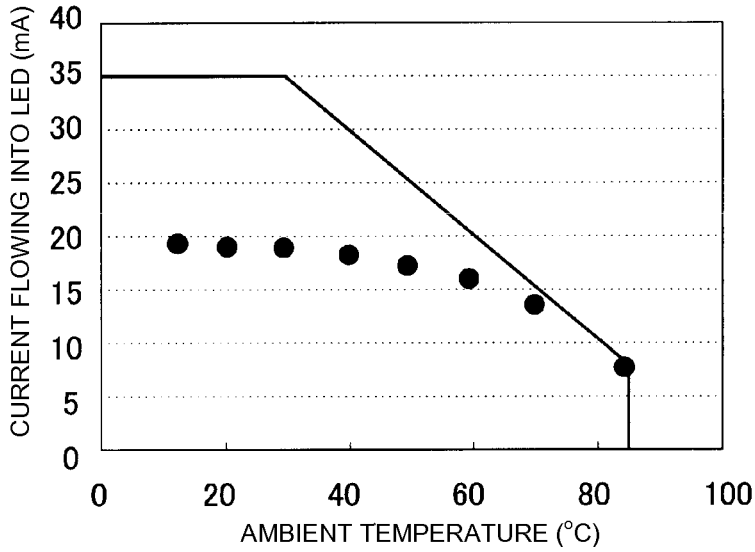
FIG. 3 is a graph showing a temperature characteristic of a current flowing into the LED element with respect to a working example of the LED drive circuit shown in FIG. 1.

The LED drive circuit 10 shown in FIG. 1 was formed using an LED element manufactured by the Nichia Corporation, NTSSW008CT, as the LED element 12 and an NTC thermistor manufactured by Murata Manufacturing Co., Ltd., NCP15XW222J03RC (25° C. resistance value 2.2 kΩ±5%, B constant (25/50° C.) 3950K±3%), as the temperature sensing element 16. Assuming that the output current of the constant-current output unit 14 is 20 mA, a current flowing into the LED element 12 in the LED drive circuit 10 is shown in FIG. 3. In FIG. 3, a solid line indicates the temperature characteristic of the allowable forward current of the LED element 12 and solid circles indicate a current flowing into the LED element 12.

As is understood from FIG. 3, the current flowing into the LED element 12 varies while taking a shape according to the temperature characteristic of the allowable forward current in a range lower than the allowable forward current of the LED element 12. For this reason, the value of a current flowing into the LED element 12 at room temperature can be made twice that in the related art where the inflow current is adjusted in accordance with the allowable forward current at high temperature.

This makes it possible to make the luminance of the LED element 12 at room temperature about twice that in a case where the related-art LED drive circuit is used.

Second Preferred Embodiment

Figure 4:
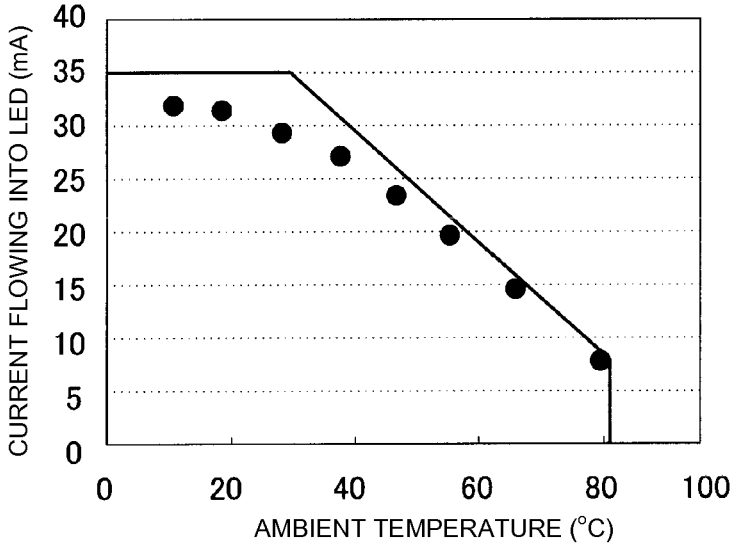
FIG. 4 is a graph showing a temperature characteristic of a current flowing into the LED element with respect to the working example of the LED drive circuit shown in FIG. 2.

The LED drive circuit 20 shown in FIG. 2 was formed using an LED element manufactured by the Nichia Corporation, NTSSW008CT, as the LED element 12, an NTC thermistor manufactured by Murata Manufacturing Co., Ltd., NCP15XQ102J03RC (25° C. resistance value 1 kΩ±5%, B constant (25/50° C. 3650K±2%), as the temperature sensing element 16, and a fixed resistance having a resistance value of 35Ω±5% as the fixed resistance 18. Assuming that the output current of the constant-current output unit 14 is 35 mA, a current flowing into the LED element 12 in the LED drive circuit 20 is shown in FIG. 4. In FIG. 4, a solid line indicates the temperature characteristic of the allowable forward current of the LED element 12 and solid circles indicate a current flowing into the LED element 12.

By using the temperature sensing element 16 and connecting the fixed resistance 18 to the temperature sensing element 16 in series, the temperature change rate of the combined resistance value of this series connecting portion can be adjusted. This makes it possible to adjust the current passing through the LED element 12, making it possible to obtain a characteristic where the current varies while taking a shape similar to the temperature characteristic of the allowable forward current, as shown in FIG. 4. This makes it possible to sufficiently exhibit the functions of the LED element 12, making it possible to obtain a luminance close to the maximum luminance at which the LED element 12 can emit light at room temperature. Also, by connecting the fixed resistance 18 to the temperature sensing element 16 in series, flow of a current having a certain level or more into the temperature sensing element 16 can be prevented. Thus, thermal runaway of the temperature sensing element 12 can be prevented.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An LED drive circuit comprising:

an LED element;

a constant-current output unit arranged to output a constant current; and a temperature sensing element including an NTC thermistor having a resistance value that gradually decreases with increasing temperature; wherein the LED element, the constant-current output unit, and the temperature sensing element constitute a constant-current circuit;

the LED element is connected to the constant-current output unit in series;

the temperature sensing element is connected to the LED element in parallel;

the temperature sensing element is arranged to adjust a current flowing through the LED element such that the current flowing through the LED element decreases with increasing temperature; and a sum of the current flowing through the LED element and a current flowing through the temperature sensing element is constant at all temperatures.

2. The LED drive circuit according to claim 1, further comprising a fixed resistance connected to the temperature sensing element in series, wherein a series connecting portion including the temperature sensing element and the fixed resistance is connected to the LED element in parallel.

3. The LED drive circuit according to claim 1, wherein if a resistance value of the LED element at a temperature T is represented by $R_L$, a resistance value of the temperature sensing element at the temperature T is represented by $R_S$ at the temperature T, an allowable forward current of the LED element is represented by $I_M$, and a value of a current outputted from the constant-current output unit at the temperature T is represented by I, a relationship $I_M > I/\{(R_L/R_S)+1\}$ is established.

4. The LED drive circuit according to claim 2, wherein if a resistance value of the LED element at a temperature T is represented by $R_L$, a combined resistance of a series circuit including the temperature sensing element and the fixed resistance at the temperature T is represented by $R_T$, an allowable forward current of the LED element at the temperature T is represented by $I_M$, and a value of a current outputted from the constant-current output unit at the temperature T is represented by I, a relationship $I_M > I/\{(R_L/R_T)+1\}$ is established.

* * * * *